US009032676B2

(12) United States Patent
Yarmo

(10) Patent No.: US 9,032,676 B2
(45) Date of Patent: May 19, 2015

(54) WALL SIDING CORNER COVER APPARATUS, SYSTEM, AND RELATED METHODS

(71) Applicant: Brandon Yarmo, Hudson, NH (US)

(72) Inventor: Brandon Yarmo, Hudson, NH (US)

( * ) Notice: Subject to any disclaimer, the term of this patent is extended or adjusted under 35 U.S.C. 154(b) by 0 days.

(21) Appl. No.: 14/265,440

(22) Filed: Apr. 30, 2014

(65) Prior Publication Data

US 2015/0000219 A1 Jan. 1, 2015

Related U.S. Application Data

(60) Provisional application No. 61/839,935, filed on Jun. 27, 2013.

(51) Int. Cl.
*E04B 2/42* (2006.01)
*E04F 13/073* (2006.01)

(52) U.S. Cl.
CPC ..... *E04F 13/0733* (2013.01)

(58) Field of Classification Search
CPC ..... E04F 13/0733
USPC ..... 52/287.1, 288.1, 272, 279–281, 282.1, 52/282.3, 282.4, 716.1, 716.2, 716.8, 52/717.01, 717.04, 717.05, 717.06, 52/254–255, 309.4
See application file for complete search history.

(56) References Cited

U.S. PATENT DOCUMENTS 3,525,188 A * 8/1970 Torbett ..... 52/288.1
3,742,668 A 7/1973 Oliver
4,104,839 A * 8/1978 Balzer et al. ..... 52/288.1
4,430,833 A * 2/1984 Balzer et al. ..... 52/255
4,642,957 A * 2/1987 Edwards ..... 52/242
4,706,426 A * 11/1987 Rumsey ..... 52/232
4,999,961 A * 3/1991 McNary ..... 52/287.1
5,203,135 A * 4/1993 Bastian ..... 52/848
5,222,343 A 6/1993 Anderson
5,542,222 A * 8/1996 Wilson et al. ..... 52/287.1
5,560,170 A 10/1996 Ganser et al.
5,740,642 A * 4/1998 Koenig et al. ..... 52/255
5,974,748 A * 11/1999 Sciuga et al. ..... 52/287.1
6,122,878 A 9/2000 Pliley
6,360,508 B1 3/2002 Pelfrey et al.
6,405,503 B1 6/2002 Reed
6,553,732 B2 4/2003 Shaw
6,729,086 B2 * 5/2004 Razetto ..... 52/287.1
7,591,118 B2 9/2009 Shaw et al.
7,654,050 B2 2/2010 Justice
7,743,581 B2 6/2010 Shaw et al.
8,141,308 B2 3/2012 Cashman
8,402,707 B2 3/2013 Mitchell et al.
2001/0022056 A1 * 9/2001 Gifford ..... 52/311.1

(Continued)

*Primary Examiner* — Beth Stephan
(74) *Attorney, Agent, or Firm* — Hayes Soloway PC

(57) ABSTRACT

A wall siding corner cover apparatus having an elongated length is provided. A corner portion is formed from first and second sides connected together at proximal ends of each of the first and second sides, wherein the first side is positioned substantially perpendicular to the second side. A first ending portion is connected to a distal end of the first side and a second ending portion is connected to a distal end of the second side. A first rear leg is connected to the first ending portion and a second rear leg is connected to the second ending portion. Each of the first and second rear legs extends towards the proximal ends of each of the first and second sides, respectively. Each of the first and second rear legs terminates in a position between the proximal and distal ends of each of the first and second sides, respectively.

5 Claims, 8 Drawing Sheets

(56) References Cited

U.S. PATENT DOCUMENTS

| | | | | |
|---|---|---|---|---|
| 2004/0074175 | A1* | 4/2004 | Tierney | 52/255 |
| 2009/0235612 | A1 | 9/2009 | Shaw et al. | |
| 2010/0011690 | A1 | 1/2010 | Schwarz et al. | |
| 2010/0212234 | A1 | 8/2010 | Monteer | |
| 2011/0056144 | A1 | 3/2011 | Hicks | |
| 2011/0185670 | A1 | 8/2011 | Mitchell et al. | |
| 2012/0067002 | A1 | 3/2012 | Waters et al. | |
| 2012/0151850 | A1 | 6/2012 | Cashman | |

* cited by examiner

200

WALL SIDING CORNER COVER APPARATUS, SYSTEM, AND RELATED METHODS

CROSS REFERENCE TO RELATED APPLICATION

This application claims benefit of U.S. Provisional Application Ser. No. 61/839,935, entitled, "Wall Siding Corner Cover Apparatus" filed Jun. 27, 2013, the entire disclosure of which is incorporated herein by reference.

FIELD OF THE DISCLOSURE

The present disclosure is generally related to wall siding devices and more particularly is related to a wall siding corner cover apparatus.

BACKGROUND OF THE DISCLOSURE

Siding has long been used to protect the exterior walls of structures such as houses. Such siding is often made of vinyl or aluminum, and is attached to the exterior wall of a structure. At wall junction, such as corners, a corner post is used to retain the ends of the siding to the wall and to provide an aesthetically appealing junction between the walls. Corner posts are generally elongated structures that are manufactured by extrusion or molding, having an outside corner surface, a J-channel, and an attachment portion having holes or slots for fastening the corner post to the wall. During installation, the corner post is positioned on the corner of the building prior to installation of the siding and fasteners, such as screws or nails, are inserted into the holes within the attachment portion to retain the corner post to the wall. Then the siding is installed on the wall sections, with the end of each siding sheet located within the J-channel.

While corner posts are satisfactory for many uses, they have significant drawbacks. Notably, when a corner post becomes damaged, old, outdated and needs replacing, it can be very time consuming to replace. The siding sheets must first be removed before it is possible to gain access to the fasteners in the attachment portions. It can take hours to remove and replace a single corner post which is inefficient and creates significant labor expenses. Another drawback of corner posts is that they often lack in aesthetic appeal. Building owners, especially homeowners, frequently want to replace the standard corner post with an upgraded, better-looking corner post that may increase the aesthetic appeal of the building, and ultimately increase the value of the building. Corner posts with larger foot prints are often more desired, but they present additional problems with installation, since the siding sheets must be cut to fit with the positioning of the J-channels of the larger corner posts. Since it is time consuming and difficult to replace these corner posts, the building owners are often left with the choice of dealing with the original corner posts or incurring the time, labor, and expense of fully replacing the corner post.

Thus, a heretofore unaddressed need exists in the industry to address the aforementioned deficiencies and inadequacies.

SUMMARY OF THE DISCLOSURE

Embodiments of the present disclosure provide a wall siding corner cover apparatus having an elongated length. Briefly described, in architecture, one embodiment of the apparatus, among others, can be implemented as follows. The apparatus includes a corner portion formed from a first side and a second side connected together at proximal ends of each of the first and second sides, wherein the first side is positioned substantially perpendicular to the second side. A first ending portion is connected to a distal end of the first side and a second ending portion is connected to a distal end of the second side. A first rear leg is connected to the first ending portion and a second rear leg is connected to the second ending portion, wherein each of the first and second rear legs extends towards the proximal ends of each of the first and second sides, respectively, and wherein each of the first and second rear legs terminates in a position between the proximal and distal ends of each of the first and second sides, respectively.

The present disclosure can also be viewed as providing a system for covering a wall siding corner post. Briefly described, in architecture, one embodiment of the system, among others, can be implemented as follows. A wall siding corner post is connected to a building structure with at least one fastener. A plurality of wall siding sections is positioned proximate to the wall siding corner post, wherein an end of the plurality of wall siding sections are positioned within a channel of the wall siding corner post. A wall siding corner cover apparatus is positioned covering the wall siding corner post. The wall siding corner cover apparatus comprises a corner portion formed from a first side and a second side connected together at proximal ends of each of the first and second sides, wherein the first side is positioned substantially perpendicular to the second side. A first ending portion is connected to a distal end of the first side and a second ending portion is connected to a distal end of the second side. A first rear leg is connected to the first ending portion and a second rear leg is connected to the second ending portion, wherein each of the first and second rear legs extends towards the proximal ends of each of the first and second sides, respectively, and wherein each of the first and second rear legs terminates in a position between the proximal and distal ends of each of the first and second sides, respectively, wherein at least one of the first and second rear legs is positioned within the channel of the wall siding corner post.

The present disclosure can also be viewed as providing a method for covering a wall siding corner post. In this regard, one embodiment of such a method, among others, can be broadly summarized by the following steps: providing a wall siding corner cover apparatus positioned covering the wall siding corner post, the wall siding corner cover apparatus comprising a corner portion formed from a first side and a second side connected together at proximal ends of each of the first and second sides, wherein the first side is positioned substantially perpendicular to the second side, a first ending portion connected to a distal end of the first side and a second ending portion connected to a distal end of the second side, and a first rear leg connected to the first ending portion and a second rear leg connected to the second ending portion, wherein each of the first and second rear legs extends towards the proximal ends of each of the first and second sides, respectively, and wherein each of the first and second rear legs terminates in a position between the proximal and distal ends of each of the first and second sides, respectively; and positioning at least one of the first and second rear legs within a channel of a wall siding corner post connected to a building structure with at least one fastener, thereby covering the wall siding corner post with the wall siding corner cover apparatus.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
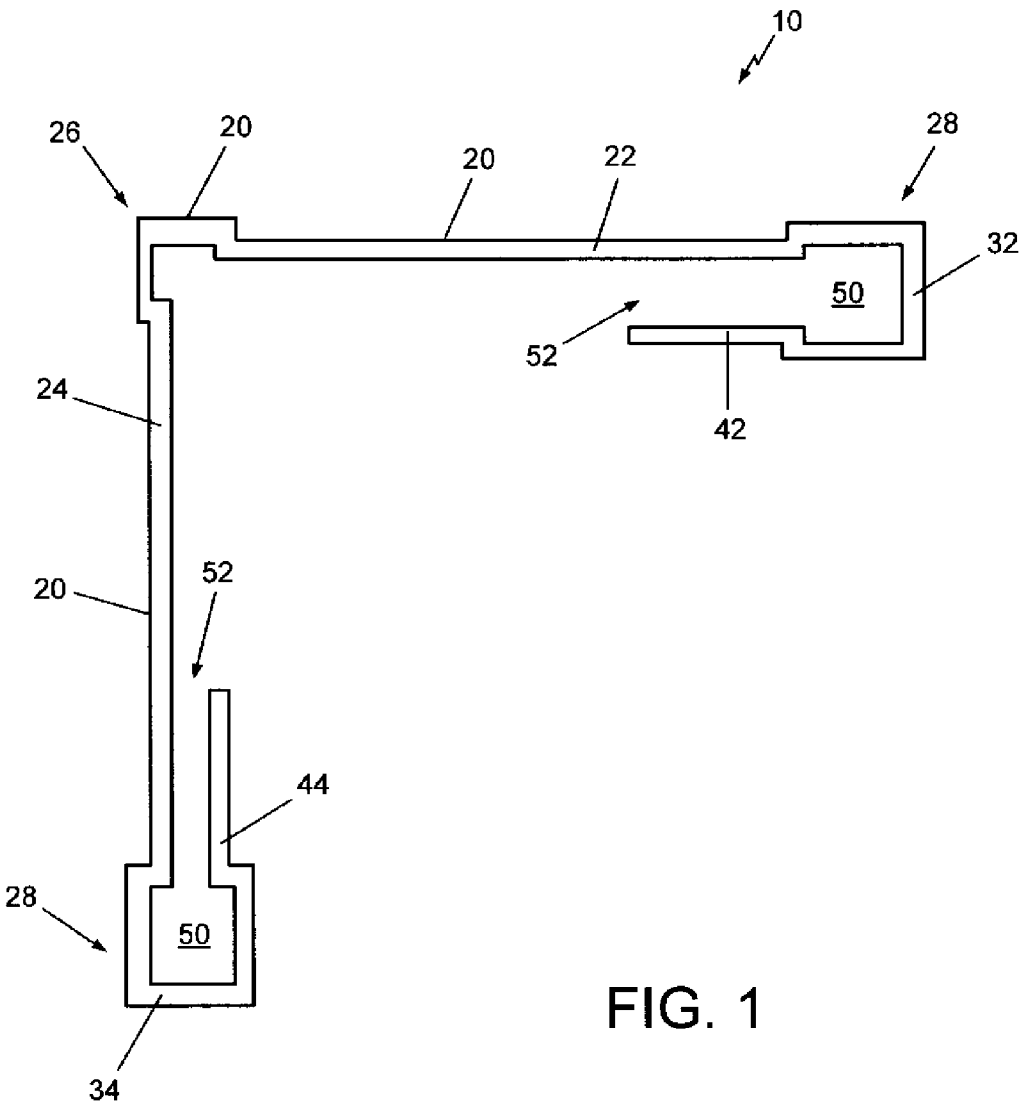
FIG. 1 is a cross-sectional illustration of a wall siding corner cover apparatus, in accordance with a first exemplary embodiment of the present disclosure.

FIG. 1 is a cross-sectional illustration of a wall siding corner cover apparatus 10, in accordance with a first exemplary embodiment of the present disclosure. The wall siding corner cover apparatus 10, which may be referred to herein as 'apparatus 10' has an elongated length. A corner portion 20 is formed from a first side 22 and a second side 24 connected together at proximal ends 26 of each of the first side 22 and second side 24, wherein the first side 22 is positioned substantially perpendicular to the second side 24. First and second ending portions 32, 34 are connected to the first and second sides 22, 24, respectively, at distal ends 28 thereof. A first rear leg 42 is connected to the first ending portion 32 and a second rear leg 44 is connected to the second ending portion 34, wherein each of the first and second rear legs 42, 44 extends towards the proximal ends 26 of each of the first and second sides 22, 24, respectively. Each of the first and second rear legs 42, 44 terminates in a position between the proximal end 26 and distal end 28 of the first and second sides 22, 24, respectively.

The apparatus 10 may be used to cover, retrofit, or upgrade a conventional corner post used with siding, such as vinyl or aluminum siding. The apparatus 10 has an elongated length that commonly greatly exceeds its width. For example, the apparatus 10 may have a length of 6 feet, 12 feet, 20 feet, or any other length. The apparatus 10 may be constructed from any material or materials commonly used in the construction of siding, including but not limited to vinyl, PVC, or aluminum. The apparatus 10 may be manufactured in any color, with any type of texturing or configuration, such as those commonly selected to imitate traditional wood grain, ribbing, or other texturing.

The readily visible portion of the apparatus 10 is formed from the corner portion 20, generally designated by the first and second sides 22, 24 connected together at proximal ends 26 thereof at a substantially perpendicular angle. As can be seen, the connected portion at the proximal ends 26 may be raised for aesthetic purposes, or to house installation materials, such as a foam material 80 that assists with installation and prevents insects from taking up residence within the apparatus 10. The foam material 80 may positioned between an interior corner of the connection of proximal ends of each of the first and second sides 22, 24 and an exterior corner of the wall siding corner post 60 connected to the building structure 12. The first and second sides 22, 24 may extend any length away from the proximal end 26, such as 3 inches, 5 inches, or another dimension. The first and second sides 22, 24 may also be partially inset, such that a portion of each of the first and second sides extends inwards, towards the first and second rear legs 42, 44, respectively. The inset may be aesthetically pleasing.

While the first and second arms 22, 24 are positioned substantially perpendicular from one another, it is noted that their relative positioning may vary, due to material flexibility or the intended used of the apparatus 10. For example, the first and second arms 22, 24 may have a relative angle that is less than 90°, thereby allowing the first and second arms 22, 24 to have a natural bias towards the building wall when installed. It may be understood that the angle between the first and second arms 22, 24 may be positioned substantially between 80° and 100°, or another angular amount. For instance, if the corner of the building structure that is being covered by the apparatus 10 is a non-perpendicular angle, the apparatus 10 may be designed to have any relative angle between the first and second arms 22, 24.

At the distal end 28 of the first and second arms 22, 24, first and second ending portions 32, 34 are formed, generally integrally connected to the first and second sides 22, 24, respectively. The first and second ending portions 32, 34 may have an angular position relative to the first and second arms 22, 24, respectively, that allows for the formation of terminating wall at the distal end 28. On each of the first and second ending portions 32, 34, a first rear leg 42 and a second rear leg 44 are connected thereto, respectively. Each of the first and second rear legs 42, 44 may be connected integrally with the first and second ending portions 32, 34 and extends towards the proximal ends 26 of the first and second sides 22, 24, respectively. Each of the first and second rear legs 42, 44 may be positioned substantially parallel to each of the first and second sides 22, 24, respectively. The first and second rear legs 42, 44 terminate proximate to a middle portion of the first and second arms 22, 24, respectively, such as a middle portion positioned between the proximal end 26 and distal end 28 of the first and second sides 22, 24, respectively. The combination of the first and second arms 22, 24, the first and second ending portions 32, 34, and the first and second rear legs 42, 44 may form a pocket 50 within each of the distal ends 28. Furthermore, a channel 52 may be formed between each of the first and second rear legs 42, 44 and the first and second arms 22, 24, respectively.

Figure 2:
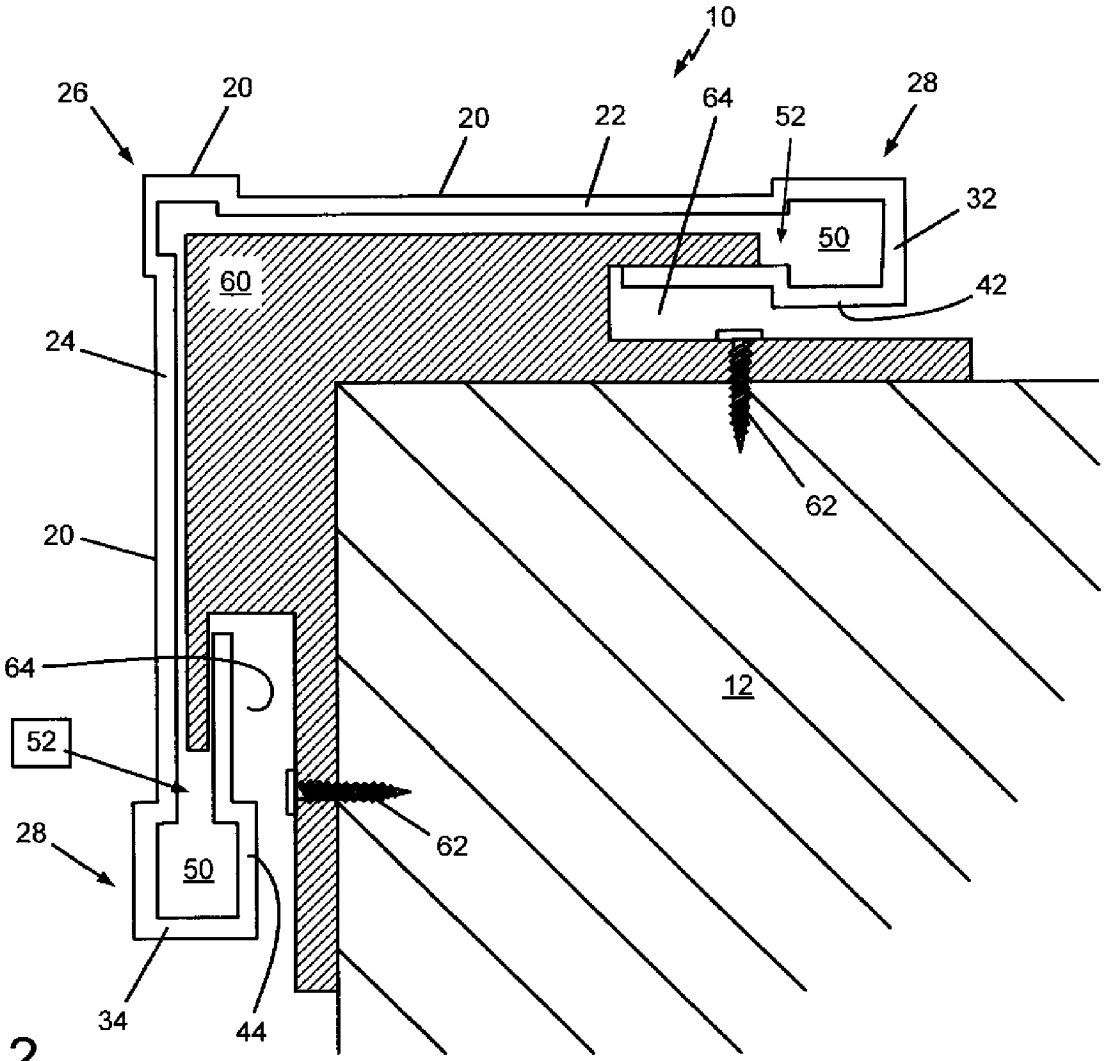
FIG. 2 is a cross-sectional illustration of the wall siding corner cover apparatus, in accordance with the first exemplary embodiment of the present disclosure.

FIG. 2 is a cross-sectional illustration of the apparatus 10, in accordance with the first exemplary embodiment of the present disclosure. The apparatus 10 is depicted in use on a structure 12 and connected to a corner post 60. The corner post 60 is conventionally used with siding, as is discussed in the background of the present disclosure. As can be seen the corner post 60 is fastened to the structure 12 with a plurality of fasteners 62. Near where the fasteners 62 are located, a channel 64, commonly referred to as a J-channel, is formed by the corner post 60. The channel 64 is conventionally used to retain the ends of the siding sheets, as is depicted relative to FIG. 3. The apparatus 10 may connect to the corner post 60 by inserting each of the first and second rear legs 42, 44 into each of the channels 64 of the corner post 60. The first and second rear legs 42, 44 may be biased against the interior surface of the channels 64 to contact the surface and frictionally retain the apparatus 10 in place. While the contact between the first and second rear legs 42, 44 and the channels 64 may be sufficient to hold the apparatus 10 in place, it is noted that a fastener, such as a screw, an adhesive, or a rivet, may be used to ensure that the apparatus 10 does not move.

In terms of installation, the apparatus 10 may be installed easily on the corner post 60 by flexing the distal ends 28 of the apparatus 10 and inserting the first and second rear legs 42, 44 into the channels 64. No special tools are needed, nor is removal of the corner post 60 required. The overall foot print of the apparatus 10, i.e., the visible length of each of the first and second arms 22, 24 is significantly larger than the foot print of the conventional corner post 60, which many find to be more aesthetically appealing. Furthermore, even when the corner post 60 is damaged, such as by being cracked, faded, or otherwise undesirable, the apparatus 10 may fully cover the visible portions of the corner post 60 to prevent their unsightly appearance.

Figure 3:
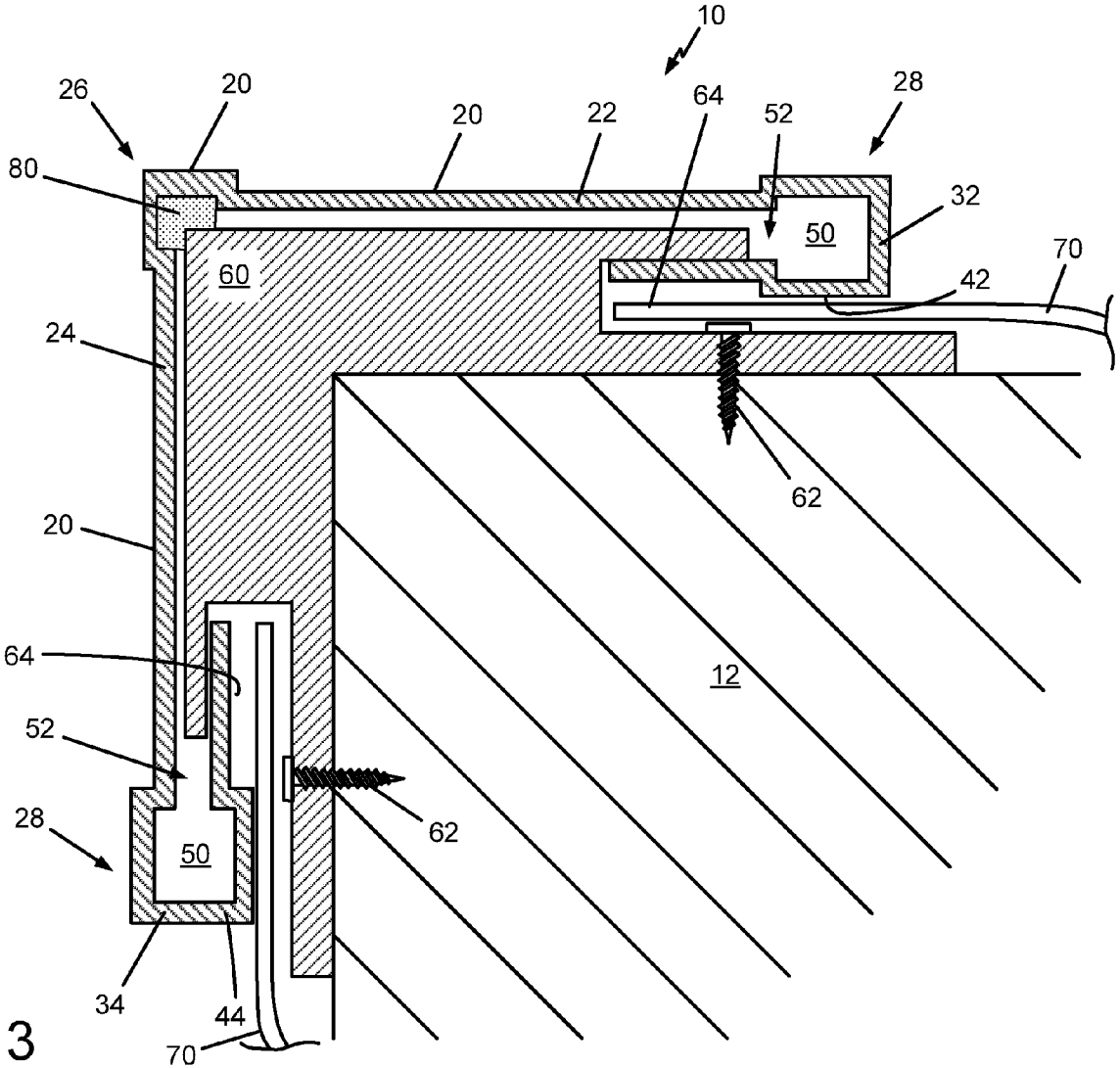
FIG. 3 is a cross-sectional illustration of the wall siding corner cover apparatus, in accordance with the first exemplary embodiment of the present disclosure.

FIG. 3 is a cross-sectional illustration of the apparatus 10, in accordance with the first exemplary embodiment of the present disclosure. Specifically, FIG. 3 depicts the apparatus 10 in use with the corner post 60 and with siding sheets 70, wherein the apparatus 10 is identified with reference characters described relative to FIGS. 1-2. The siding sheets 70 may be affixed to the structure 12 with their ends positioned within the channel 64 of the corner post 60. The siding sheets 70 may cover the fastener 62 and abut the first and second rear legs 42, 44 of the apparatus 10. It can be seen that the apparatus 10 may be installed on the corner post 60 when the siding sheets 70 are positioned in the channels 64, since the first and second rear legs 42, 44 may be inserted between the siding sheets 70 and the surface of the channel 64. When viewing the apparatus 10 and the structure 12 from an exterior position, one will only be able to see the exterior surface of the apparatus 10 and the siding sheets 70, thereby providing an aesthetically appealing structure covering.

Figure 4:
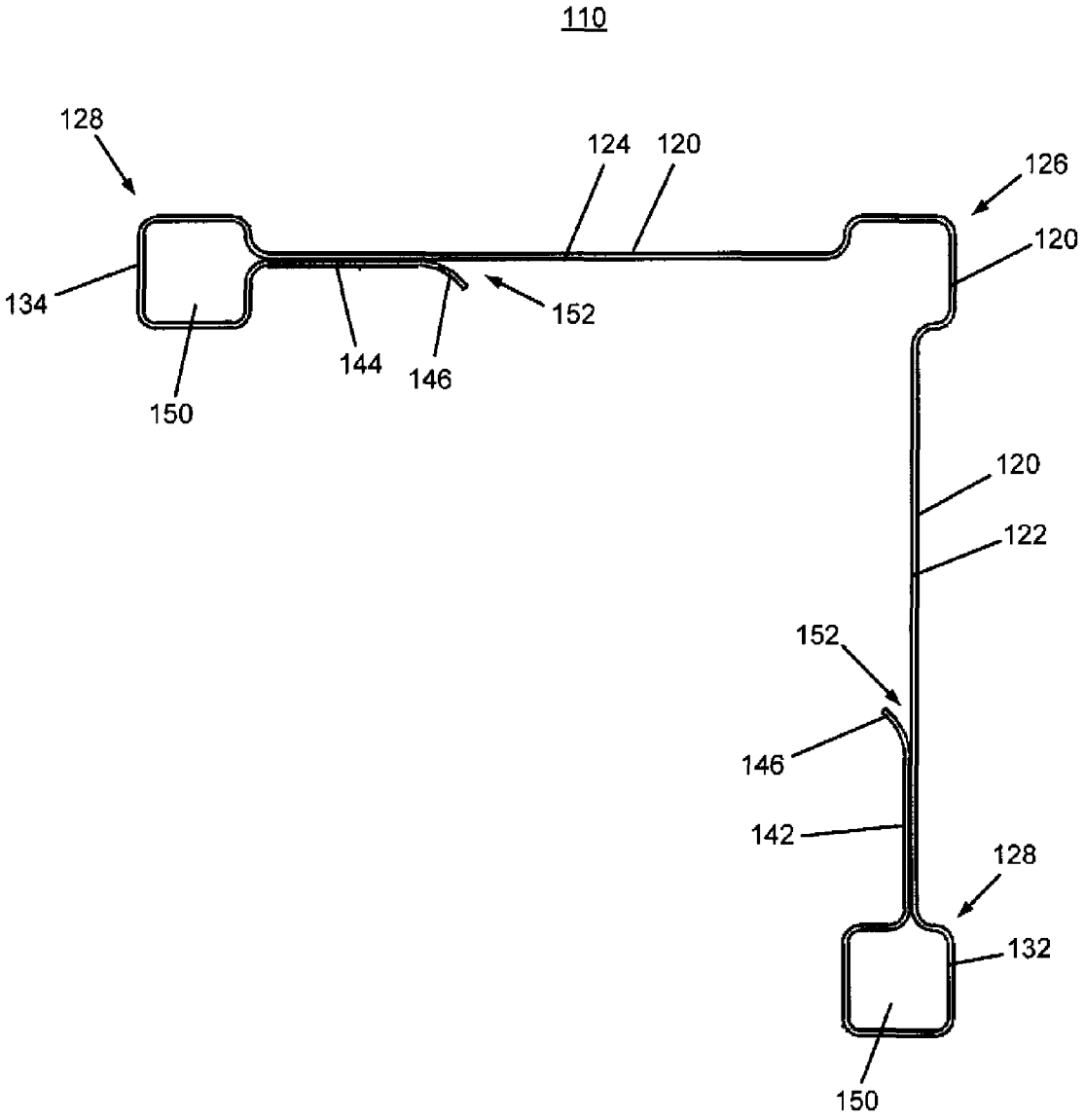
FIG. 4 is a cross-sectional illustration of a wall siding corner cover apparatus, in accordance with a second exemplary embodiment of the present disclosure.
Figure 5:
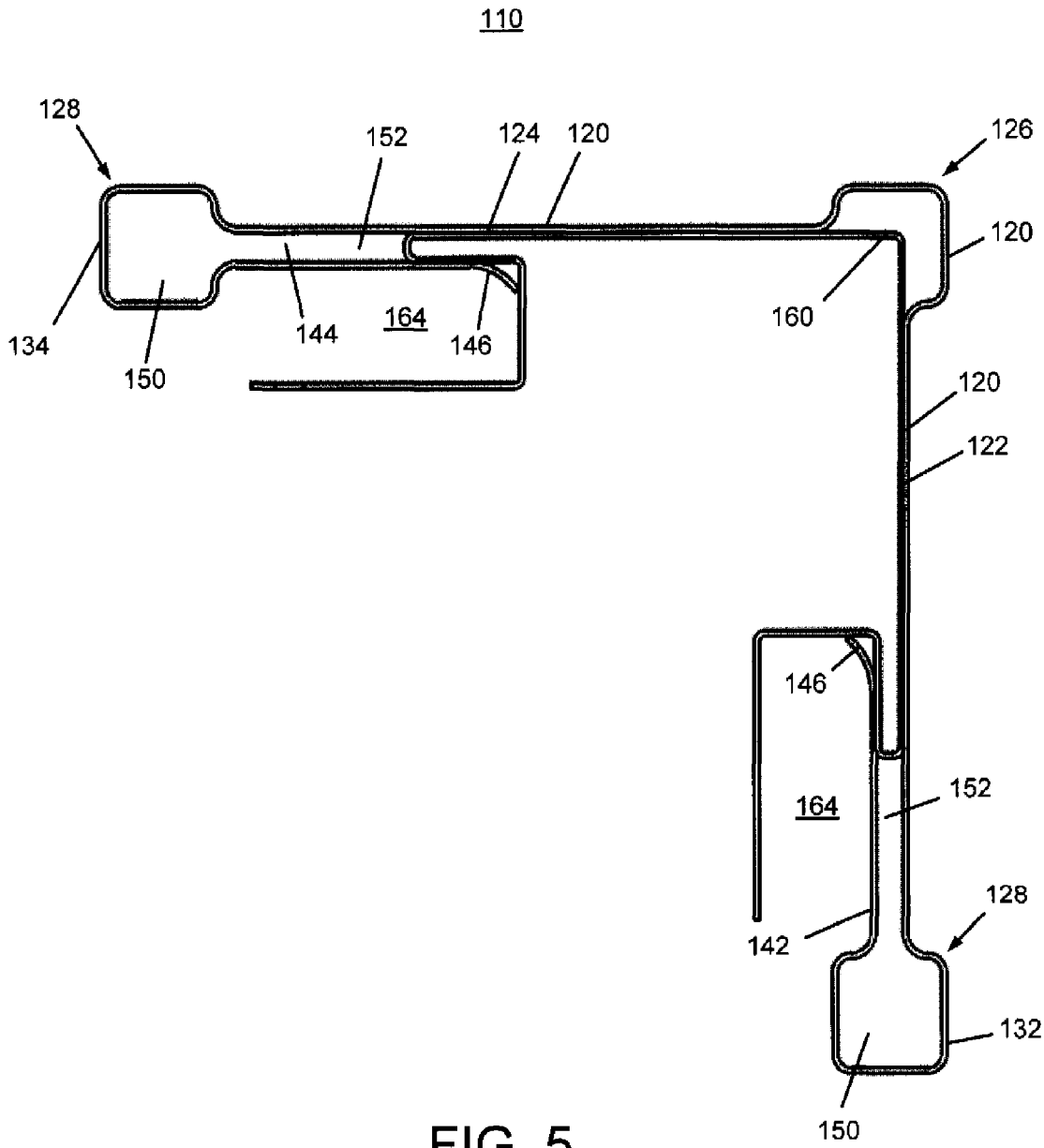
FIG. 5 is a cross-sectional illustration of a wall siding corner cover apparatus, in accordance with the second exemplary embodiment of the present disclosure.

FIG. 4 is a cross-sectional illustration of a wall siding corner cover apparatus 110, in accordance with a second exemplary embodiment of the present disclosure. FIG. 5 is a cross-sectional illustration of a wall siding corner cover apparatus 110, in accordance with the second exemplary embodiment of the present disclosure. The wall siding corner cover apparatus 110, which may be referred to herein as 'apparatus 110' has an elongated length and may include any of the features, structures, or components discussed relative to the first exemplary embodiment of this disclosure. In FIG. 4, the apparatus 110 is depicted without contacting structures, whereas in FIG. 5, the apparatus 110 is depicted in use on an existing corner post 160.

As is shown in FIGS. 4-5, a corner portion 120 is formed from a first side 122 and a second side 124 connected together at proximal ends 126 of each of the first side 122 and second side 124, wherein the first side 122 is positioned substantially perpendicular to the second side 124. First and second ending portions 132, 134 are connected to the first and second sides 122, 124, respectively, at distal ends 128 thereof. A first rear leg 142 is connected to the first ending portion 132 and a second rear leg 144 is connected to the second ending portion 134, wherein each of the first and second rear legs 142, 144 extends towards the proximal ends 126 of each of the first and second sides 122, 124, respectively. Each of the first and second rear legs 142, 144 terminates in a position between the proximal end 126 and distal end 128 of the first and second sides 122, 124, respectively. The combination of the first and second arms 122, 124, the first and second ending portions 132, 134, and the first and second rear legs 142, 144 may form a pocket 150 within each of the distal ends 128. Furthermore, a channel 152 may be formed between each of the first and second rear legs 142, 144 and the first and second arms 122, 124, respectively.

As discussed relative to FIG. 2, the existing corner post 160 is conventionally used with siding and includes a channel 164, commonly referred to as a J-channel, formed by the existing corner post 160. The apparatus 110 may connect to the corner post 160 by inserting each of the first and second rear legs 142, 144 into each of the channels 164 of the existing corner post 160. The first and second rear legs 142, 144 may be biased against the interior surface of the channels 164 to contact the surface and frictionally retain the apparatus 110 in place. The apparatus 110 may be designed such that each of the first and second rear legs 142, 144 is positioned in contact with each of the first and second sides 122, 124, respectively, as is shown in FIG. 4. This contact may include biased contact, in which the each of the first and second rear legs 142, 144 applies a force against each of the first and second sides 122, 124, respectively. With this design, the channel 152 may be closed or blocked until the first and second rear legs 142, 144 are biased away from the first and second sides 122, 124, respectively.

To assist with biasing the first and second rear legs 142, 144, flared ends 146 may be included. The flared ends 146 may be flared to extend away from each of the first and second sides 122, 124, respectively, which may assist an installer of the apparatus 110 in opening the channel 152 between each of the first and second rear legs 142, 144 and the first and second walls 122, 124, respectively. For example, the flared ends 146 may allow for the installer's finger tips to conveniently grasp the ends of the first and second rear legs 142, 144. While the contact between the first and second rear legs 142, 144 and the channels 164 may be sufficient to hold the apparatus 110 in place, it is noted that a fastener, such as a screw, an adhesive, or a rivet, may be used to ensure that the apparatus 110 does not move.

The apparatus 110 may be installed easily on the existing corner post 160 by flexing the distal ends 128 of the apparatus 110 and inserting the first and second rear legs 142, 144 into the channels 164. No special tools are needed, nor is removal of the existing corner post 160 required. The overall foot print of the apparatus 110, i.e., the visible length of each of the first and second arms 122, 124 is significantly larger than the foot print of the conventional corner post 160, which many find to be more aesthetically appealing. Furthermore, even when the existing corner post 160 is damaged, such as by being cracked, faded, or otherwise undesirable, the apparatus 110 may fully cover the visible portions of the existing corner post 160 to prevent their unsightly appearance.

Figure 6:
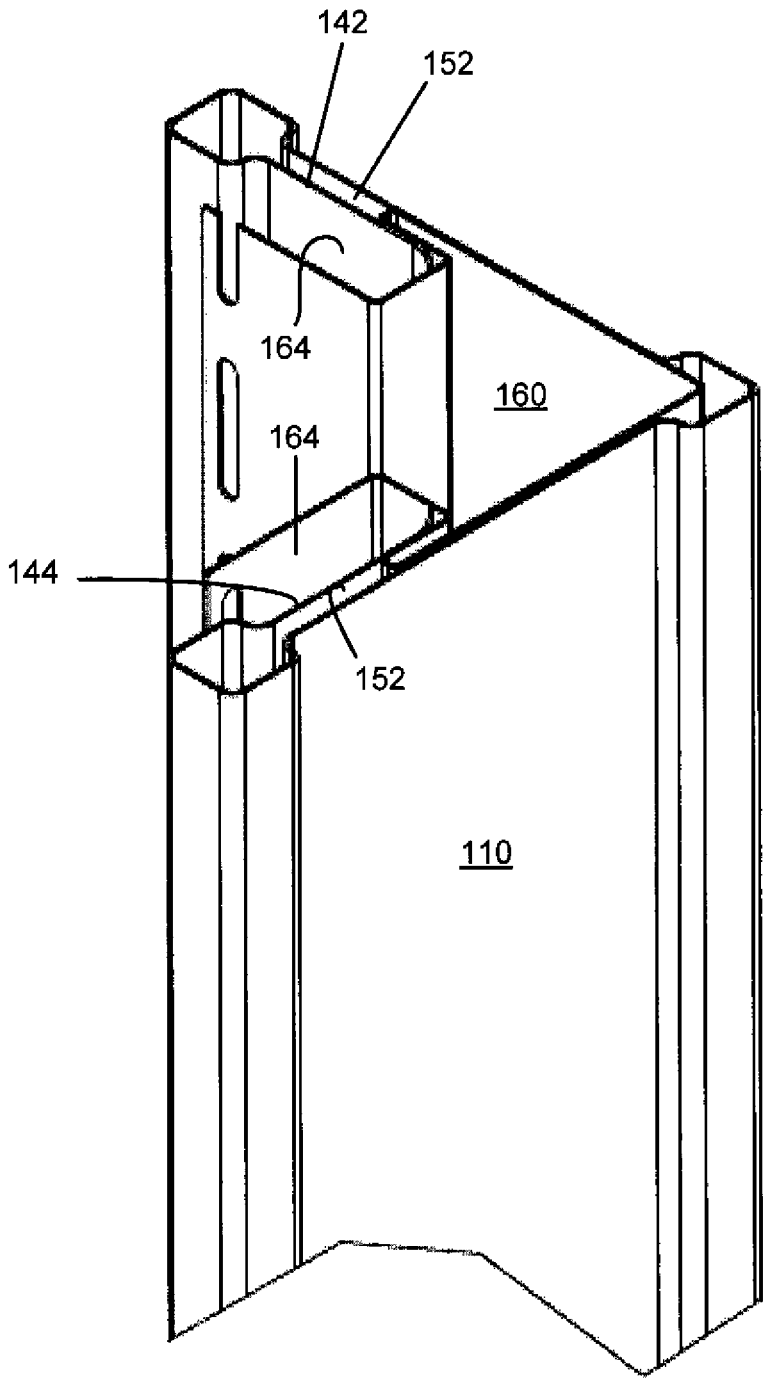
FIG. 6 is the plan view illustration of a wall siding corner cover apparatus, in accordance with the second exemplary embodiment of the present disclosure.

FIG. 6 is the plan view illustration of a wall siding corner cover apparatus 110, in accordance with the second exemplary embodiment of the present disclosure. In particular, FIG. 6 depicts the apparatus 110 in use with the existing corner post 160, and illustrates how the apparatus 110 covers the existing corner post 160 when it is applied to the existing corner post 160. As can be seen, a portion of the existing corner post 160 is positioned within the channels 152 of the apparatus 110, such that the first and second rear legs 142, 144 are positioned within the channels 164 of the existing corner post 160. Not only does the apparatus 110 cover the existing corner post 160, but the apparatus 110 also has a larger footprint area than the existing corner post 160, which is generally considered to provide a building with enhanced aesthetics.

Figure 7:
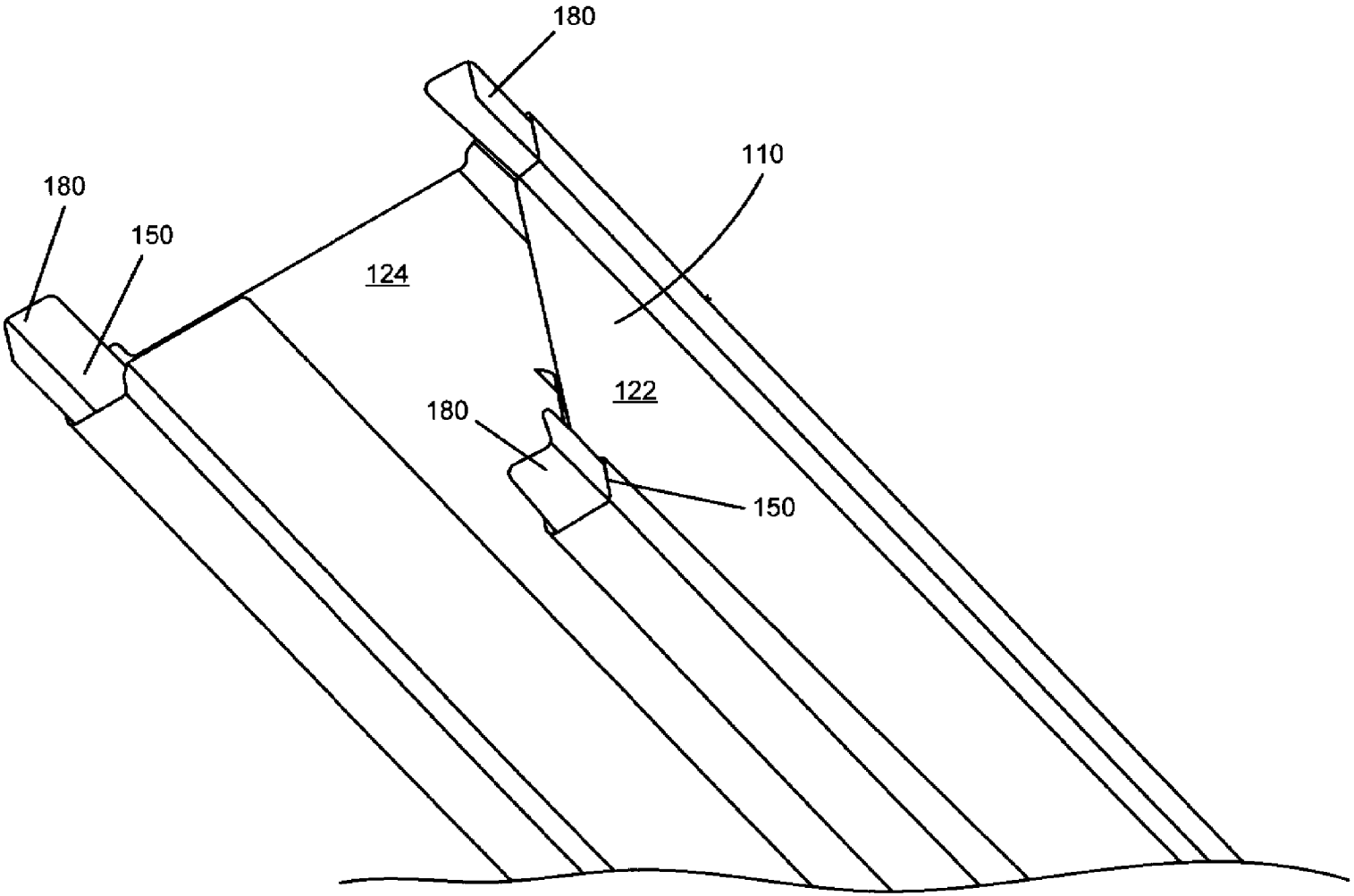
FIG. 7 is the plan view illustration of a wall siding corner cover apparatus, in accordance with the second exemplary embodiment of the present disclosure.

FIG. 7 is the plan view illustration of a wall siding corner cover apparatus 110, in accordance with the second exemplary embodiment of the present disclosure. As is shown, the apparatus 110 may be used with coupling structures 180 positioned at least partially within at least one of the first and second pockets 150 and within the connection between the first and second sides 122, 124. The coupling structures 180 may be used to connect two structures together, thereby increasing the elongated structure of the apparatus 110. The coupling structures 180 may extend beyond a terminating end of at least one of the first and second pockets 150 along a linear length of the apparatus 110. Thus, the coupling structures 180 may engage a bottom of one apparatus 110 with the top of another apparatus 110. The coupling structures 180 may be frictionally retained within the pockets 150 or utilize fasteners, adhesives, or other retainment devices.

Figure 8:
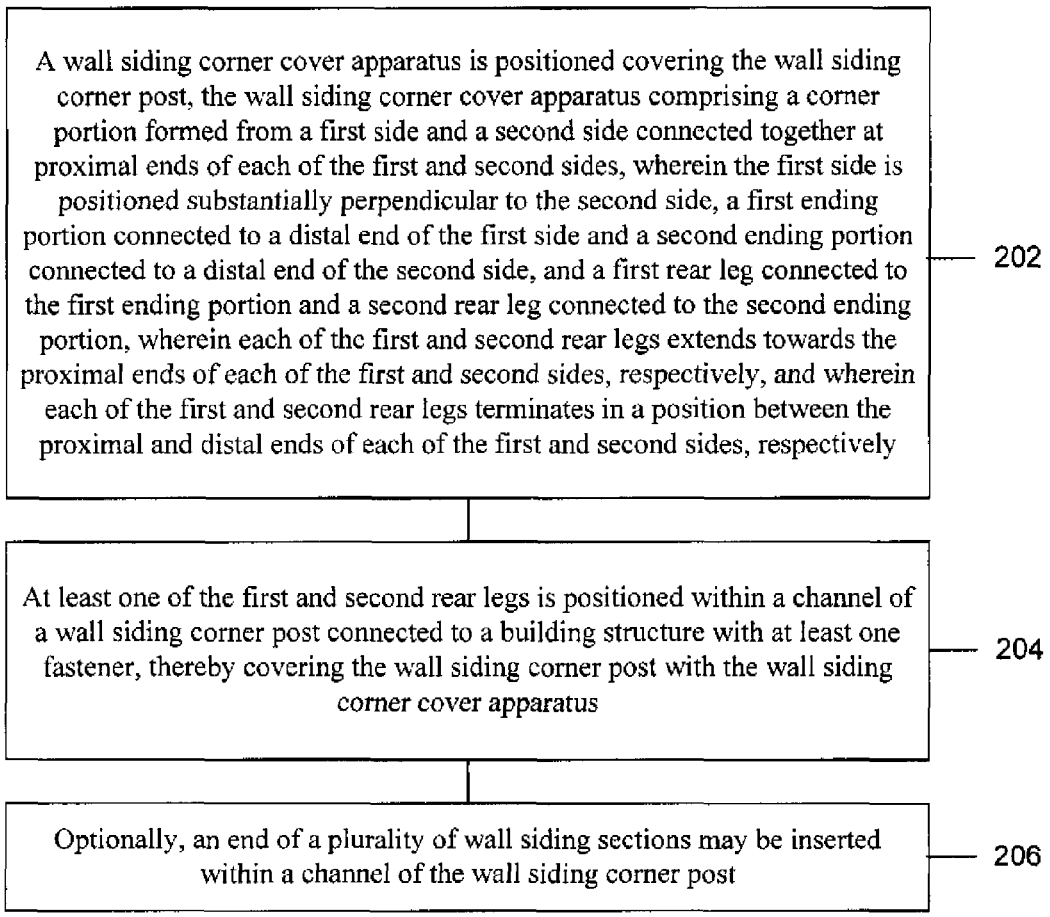
FIG. 8 is a flowchart illustrating a method for covering a wall siding corner post, in accordance with a third exemplary embodiment of the disclosure.

FIG. 8 is a flowchart 200 illustrating a method for covering a wall siding corner post, in accordance with a third exemplary embodiment of the disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 202, a wall siding corner cover apparatus is positioned covering the wall siding corner post, the wall siding corner cover apparatus comprising a corner portion formed from a first side and a second side connected together at proximal ends of each of the first and second sides, wherein the first side is positioned substantially perpendicular to the second side, a first ending portion connected to a distal end of the first side and a second ending portion connected to a distal end of the second side, and a first rear leg connected to the first ending portion and a second rear leg connected to the second ending portion, wherein each of the first and second rear legs extends towards the proximal ends of each of the first and second sides, respectively, and wherein each of the first and second rear legs terminates in a position between the proximal and distal ends of each of the first and second sides, respectively. At least one of the first and second rear legs is positioned within a channel of a wall siding corner post connected to a building structure with at least one fastener, thereby covering the wall siding corner post with the wall siding corner cover apparatus (block 204). Optionally, an end of a plurality of wall siding sections may be inserted within a channel of the wall siding corner post (block 206).

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A system for covering a wall siding corner post, the system comprising:

a wall siding corner post connected to a building structure with at least one fastener;

a plurality of wall siding sections positioned proximate to the wall siding corner post, wherein an end of the plurality of wall siding sections are positioned within a channel of the wall siding corner post; and a wall siding corner cover apparatus positioned covering the wall siding corner post, the wall siding corner cover apparatus comprising:

a corner portion formed from a first side and a second side connected together at proximal ends of each of the first and second sides, wherein the first side is positioned substantially perpendicular to the second side;

a first ending portion connected to a distal end of the first side and a second ending portion connected to a distal end of the second side; and a first rear leg connected to the first ending portion and a second rear leg connected to the second ending portion, wherein each of the first and second rear legs extends towards the proximal ends of each of the first and second sides, respectively, and wherein each of the first and second rear legs terminates in a position between the proximal and distal ends of each of the first and second sides, respectively, wherein at least one of the first and second rear legs is positioned within the channel of the wall siding corner post, wherein each of the first and second rear legs is positioned substantially parallel to and in contact with each of the first and second sides, respectively, through a portion of the wall siding corner post.

2. The system for covering a wall siding corner post of claim 1, further comprising at least one fastener connected between the wall siding corner cover apparatus and at least one of: the wall siding corner post, the building structure, and at least one of the plurality of wall siding sections.

3. The system for covering a wall siding corner post of claim 1, further comprising a quantity of foam positioned within the connection of proximal ends of each of the first and second sides, wherein the quantity of foam is positioned between an interior corner of the connection of proximal ends of each of the first and second sides and an exterior corner of the wall siding corner post connected to the building structure.

4. A method of covering a wall siding corner post, the method comprising the steps of:

providing a wall siding corner cover apparatus positioned covering the wall siding corner post, the wall siding corner cover apparatus comprising a corner portion formed from a first side and a second side connected together at proximal ends of each of the first and second sides, wherein the first side is positioned substantially perpendicular to the second side, a first ending portion connected to a distal end of the first side and a second ending portion connected to a distal end of the second side, and a first rear leg connected to the first ending portion and a second rear leg connected to the second ending portion, wherein each of the first and second rear legs extends towards the proximal ends of each of the first and second sides, respectively, and wherein each of the first and second rear legs terminates in a position between the proximal and distal ends of each of the first and second sides, respectively, and wherein each of the first and second rear legs is positioned substantially parallel to and in contact with each of the first and second sides, respectively; and positioning at least one of the first and second rear legs within a channel of the wall siding corner post connected to a building structure with at least one fastener, thereby covering the wall siding corner post with the wall siding corner cover apparatus, whereby each of the first and second rear legs is positioned in contact with each of the first and second sides, respectively, through a portion of the wall siding corner post, whereby each of the first and second rear legs is separated from each of the first and second sides respectively, with the portion of the wall siding corner post.

5. The method of claim 4, further comprising the step of inserting an end of a plurality of wall siding sections within a channel of the wall siding corner post.

* * * * *